US008800190B1

(12) United States Patent
Wilde

(10) Patent No.: US 8,800,190 B1
(45) Date of Patent: Aug. 12, 2014

(54) RECIPROCATING SENSORY SIGHTING SYSTEM FOR A LONGARM

(76) Inventor: Fred Nelson Wayne Wilde, Kalama, WA (US)

( * ) Notice: Subject to any disclaimer, the term of this patent is extended or adjusted under 35 U.S.C. 154(b) by 124 days.

(21) Appl. No.: 13/430,593

(22) Filed: Mar. 26, 2012

(51) Int. Cl.
*F41C 23/00* (2006.01)

(52) U.S. Cl.
USPC ..... 42/72; 42/71.01; 42/73; 42/75.01; 42/90; 42/94

(58) Field of Classification Search
USPC ..... 42/71.01, 72, 73, 74, 75.01, 75.02, 42/75.03, 90, 94
See application file for complete search history.

(56) References Cited

U.S. PATENT DOCUMENTS

| | | | | |
|---|---|---|---|---|
| 1,602,116 | A * | 10/1926 | Manahan et al. | 42/125 |
| 2,311,118 | A | 2/1943 | Lobdell | |
| 2,311,186 | A * | 2/1943 | Lobdell | 248/483 |
| 2,353,133 | A * | 7/1944 | Gorman | 42/130 |
| 3,245,393 | A * | 4/1966 | Rose | 124/24.1 |
| 4,663,877 | A * | 5/1987 | Bragg | 42/74 |
| 5,031,348 | A * | 7/1991 | Carey | 42/74 |
| 5,711,102 | A * | 1/1998 | Plaster et al. | 42/71.01 |
| 5,970,642 | A * | 10/1999 | Martin | 42/73 |
| 6,925,743 | B1 * | 8/2005 | DiGiovanna | 42/71.01 |
| 6,925,744 | B2 * | 8/2005 | Kincel | 42/71.01 |
| 7,104,001 | B1 * | 9/2006 | Digiovanna | 42/71.01 |
| 7,152,355 | B2 * | 12/2006 | Fitzpatrick et al. | 42/73 |
| 7,428,794 | B2 * | 9/2008 | Oz | 42/73 |
| 7,610,711 | B2 * | 11/2009 | Oz | 42/94 |
| 7,640,688 | B2 * | 1/2010 | Oz | 42/73 |
| 7,640,690 | B2 * | 1/2010 | Hines | 42/75.03 |
| 7,930,849 | B2 * | 4/2011 | Abraham et al. | 42/73 |
| 7,984,580 | B1 * | 7/2011 | Giauque et al. | 42/73 |
| 8,141,286 | B1 * | 3/2012 | Saur | 42/74 |
| 8,484,877 | B2 * | 7/2013 | Zimmerman | 42/75.01 |
| 2009/0313875 | A1 * | 12/2009 | Hines | 42/75.03 |
| 2011/0016764 | A1 * | 1/2011 | Cales | 42/90 |
| 2011/0173863 | A1 * | 7/2011 | Ingram | 42/73 |
| 2011/0270145 | A1 * | 11/2011 | Nail | 602/21 |
| 2012/0102804 | A1 * | 5/2012 | Fesas | 42/90 |
| 2012/0174457 | A1 * | 7/2012 | Edelman | 42/72 |
| 2013/0097911 | A1 * | 4/2013 | Larue | 42/73 |
| 2013/0276343 | A1 * | 10/2013 | Peters | 42/90 |

* cited by examiner

*Primary Examiner* — Michael David
(74) *Attorney, Agent, or Firm* — Empire Patents; Flory H. Blair; James D. Palmatier

(57) ABSTRACT

A reciprocating sensory sighting system with a movable cheek weld member is translationally received by a firearm frame which defines a firing chamber and a passageway from an ammunition supply to the chamber. The cheek weld member includes a body, and a frame engagement portion extending therefrom. The frame engagement portion translationally couples to the frame, reciprocating between charging and firing positions to move an ammunition round from the supply, through the passageway, and to the firing chamber. The body has an exterior surface defining a cheek seat for shooter engagement when in the firing position, and an optional rear sight. A reciprocating sensory system, with or without the reciprocating sighting system, is provided with a sensory assisting element supported by the body. A firearm having such a reciprocating cheek weld member and/or a reciprocating sensory system, are also provided, along with a retrofit charging handle system for a firearm.

20 Claims, 8 Drawing Sheets

RECIPROCATING SENSORY SIGHTING SYSTEM FOR A LONGARM

FIELD OF THE INVENTION

The present invention relates generally to a sighting and sensory system for a longarm firearm, such as a rifle or shotgun, which speeds sight picture acquisition, orients a shooter, enhances peripheral vision, and promotes shifting the center of gravity of the longarm toward a shooter for decreased shooter fatigue, better balance and maneuverability, as well as improved accuracy.

BACKGROUND

Handheld firearms may be generally classified into longarms and short arms, with short arms including pistols and revolvers, and longarms including rifles and shotguns. The following principles described here apply generally to all types of firearms, but for convenience unless specified otherwise, these principles are illustrated with respect to rifles. For instance, when holding any item of weight with arms outstretched from the body, muscle fatigue increases with either (a) an increase in the weight, or (b) an increase in the distance of the weight away from the body.

To assist in this discussion, FIG. 8 shows a prior art shooting system where a shooter S is readying to shoot a rifle R. The illustrated rifle R is an M16A4 rifle currently issued to United States soldiers worldwide, and used by law enforcement, as well as by civilians for a variety of uses including plinking, target shooting, hunting, competition, etc. The rifle R is shown shouldered in a shooting position by a United States infantry soldier S. As equipped, the illustrated rifle R has a center of gravity approximately located along dashed vertical line CG1. As the center of gravity line CG1 moves away from shooter S, muscle fatigue increases, and vice versa.

The illustrated rifle R has a two-part frame known as a "receiver," comprising an upper receiver UR and a lower receiver LR, to which a stock portion A is attached. The stock A extends from the lower receiver LR toward the shooter S to terminate in a butt portion B. The lower receiver LR defines a magazine well MW which receives a supply of ammo preloaded into a magazine clip MC. The lower receiver LR also supports a trigger mechanism T and serves as a mount for a pistol-type grip G. A trigger hand TH (here, the dominant right hand) surrounds the grip G to position the index finger to engage the trigger mechanism T. During shooting, the trigger hand TH uses grip G to pull the rifle butt B snugly against the shooter's dominant-hand shoulder to absorb recoil forces.

A rifled barrel C is supported by the upper receiver UR and terminates at a muzzle M from which a projectile, such as a bullet, is expelled. The upper receiver UR interior defines a conventional firing chamber coupled to the barrel C. The upper receiver UR also defines a conventional ejection port for expelling spent ammunition ("ammo") casings, and a conventional dust cover for keeping debris out of the firing chamber. The upper receiver UR also supports a conventional forward assist member which aids in loading slightly imperfect ammo into the firing chamber. Since these several items are all of conventional construction, they are omitted from FIG. 8 for clarity.

The rifle R also has a handguard assembly, referred to herein as a forearm F, which partially or fully surrounds a rear portion of barrel C. The non-dominant or "opposite" hand with respect to the trigger hand TH, serves as a support hand SH to hold the front portion of the rifle by resting forearm F in the palm of the support hand SH. Depending upon shooting conditions, the fingers and thumb of the support hand SH may or may not grip the rifle forearm F.

Today's law enforcement officers, as well as battlefield soldiers and others wear body armor typically constructed of an anti-ballistic fabric, ceramic, metallic or other energy absorbing, bullet retarding or deflecting materials, such as being worn by shooter S in FIG. 8. Body armor, whether worn under or over a shooter's clothing, positions the rifle butt B, and hence the entire rifle R, further away from the shooter's body than without armor. While body armor may prevent serious injury or death, it has several drawbacks in addition to being hot, it is bulky. This bulkiness of the body armor adversely affects shooting in three ways: (1) it changes target sight relief, (2) it changes cheek weld, and (3) it increases muscle fatigue.

1. Sight Relief

Conventional rifle sighting systems have what are known as "iron sights." FIG. 8 shows an iron sight set including a front sight FS mounted to barrel C near the muzzle M, and a rear sight RS mounted to, or above, the upper receiver UR. Optional enhanced target sighting may be provided by using an optic enhancer OP, such as a telescope or "scope" which may be merely a magnifying device. The optics OP may be of an enhanced design, such as a laser sights, holographic diffraction sights, competition sights, night vision sights, etc.

If these enhanced optics OP break or fail during use, current U.S. military specifications require that they provide an unobstructed view so the shooter S can see directly through the device. In this way, the iron sight set FS, RS may be used as a back-up, referred to in the industry as "Back-up Iron Sights," abbreviated as "BIS" or "BUIS." When not deployed, the front and rear sights FS, RS may be stored in rest positions, then pivoted upwardly into operational positions as shown in FIG. 8.

To aid in understanding aiming and sight design principles, a discussion of relevant terminology is helpful at this point:

"Sight Radius" or "Sight Distance" is the distance between the front sight FS and rear sight RS. Increasing the sight distance improves the accuracy of a firearm in the hands of a trained shooter.

"Sight Picture" refers to what a shooter sees when looking through the rear sight at, or for, the front sight, which is then placed upon the intended target (or directly under the target, depending upon how the scope was sighted-in).

"Sight Relief" is used in describing rifle sighting, typically when discussing scopes, to refer to the distance between the rear of the scope and the shooter's eyeball.

"Cheek Weld" refers to nestling the upper corner edge of the stock against the shooter's cheek bone above the upper teeth line. This is about the same location where a person rests their head on the heel of their hand when seated at a table, such as when one is bored.

"Sight Line" refers to the alignment of the front and rear sights FS, RS with the shooter's eyeball, and hopefully the target. In FIG. 8, the line of sight or sight line SL is indicated by a dashed line extending through the scope OP.

When an optical scope is viewed at the designed sight relief, an optimal view of the sight picture shows the target image being bright and clear, occupying the full aperture of the scope. If the sight relief is greater than the designed distance (eyeball is too far away), the target image appears small and surrounded by a shadow. This shadow shifts in size as the target image swims around inside the shadow, sometimes moving entirely out of the field of view, leaving the shooter looking at blackness. The same phenomenon occurs with binoculars when held further away from the eyes than the designed distance. Searching for the target image inside the scope wastes valuable seconds, frustrating the shooter, and leaving the shooter vulnerable to attack.

Bulky body armor exacerbates this image searching problem by shifting the rifle forward away from the eyeball, increasing the sight relief from that intended by the scope designer. The same image searching impediment occurs when using the back-up sights FS, RS with body armor, making it difficult, if not nearly impossible, to find the front sight. Thus, even with iron sights body armor impairs rapid target acquisition for a fast, accurate shot.

2. Cheek Weld

An extremely important component of obtaining an accurate sight picture is snapping the rifle stock A into a repeatable cheek weld position against the shooter's face. "Cheek" denotes the location of the stock, and "weld" denotes the concept of rigidly fusing the stock and cheek into a unitary piece. A proper cheek weld is obtained from repeated practice which develops muscle memory in the arms and torso of the shooter to "snap" the rifle into position. With a proper cheek weld, the skull serves to locate the rear sight RH in a consistent position with respect to the shooter's eyeball. The skull's rigid bone structure ensures repeatability of positioning the eyeball on the sight line SL.

Unfortunately, as bulky body armor pushes rifle R away from shooter S, the cheek weld is moved toward the stock butt B. Shifting the cheek weld rearward often lowers a shooter's eye beneath the sight line SL, so the shooter cannot even see through the rear sight RS to begin locating the front sight FS. To obtain any type of a site picture, the shooter must switch to some sort of a "jaw weld" pressing the stock against jaw J, as shown in FIG. 8.

The improper jaw weld of FIG. 8 is not as secure and accurate as a cheek weld for a variety of reasons. First, a jaw weld is inaccurate simply because the jaw is designed to move, and may do so under recoil forces during shooting. Furthermore, the shooter's mouth may be open to different positions depending upon the situation. For example, the jaw may be in an open-mouth position for breathing after running, or in a closed-mouth position or in the process of closing, such as if the teeth are clenched during recoil absorption, or if the shooter is injured. Thus, a sight picture based on a jaw weld is not always repeatable, and is subject to change during shooting. Moreover, a shooter relying on a jaw weld wastes valuable seconds attaining a proper sight picture when under fire, leaving the shooter vulnerable to attack.

3. Muscle Fatigue

Bulky body armor pushes the rifle butt B away from the shooter's body, which shifts the rifle center of gravity CG1 further away from the body, requiring the support hand SH to be extended further away from the shooter's body. Holding the support hand SH further away from the body increases muscle fatigue, particularly when shouldering a rifle for long periods of time, such as during sustained firing. Furthermore, this forward shifting of rifle R hampers maneuverability, such as during close quarter battle, when reconnoitering buildings and other tight spaces.

Another trend in shooting is to attach accessories to rifle R, such as flashlights or other illumination devices (infrared or ultraviolet detectors), extra ammunition, sighting enhancements such as scopes, laser sights, range finders, front pistol grips, etc. As these accessories are added onto the rifle generally in the region of forearm F, the center of gravity CG1 shifts further forward toward muzzle M, making the weapon front-end heavy. As discussed above, when the center of gravity CG1 shifts forward, muscle fatigue increases, tiring the shooter S.

SUMMARY OF AT LEAST ONE EMBODIMENT OF THE INVENTION

A cheek weld member is provided for a firearm having a frame defining a firing chamber and a passageway from an ammunition supplier to the firing chamber. The cheek weld member includes a body, and a frame engagement portion extending from the body. The frame engagement portion is translationally couplable to the frame to reciprocate between a firing position and a second position, and upon returning to the firing position, moving an ammunition round from the ammunition supplier through the passageway to the firing chamber. The body has an exterior surface defining a cheek seat for shooter engagement when in the firing position.

A reciprocating sensory system for a firearm is also provided with a sensory assisting element being supported by the body. A firearm having such a cheek weld member and a reciprocating sensory system, along with a retrofit charging handle system for a firearm, are also provided.

Various objects, features and advantages of at least one embodiment of the invention will become apparent from the detailed description below.

DETAILED DESCRIPTION OF CERTAIN EMBODIMENTS OF THE INVENTION

Figure 1:
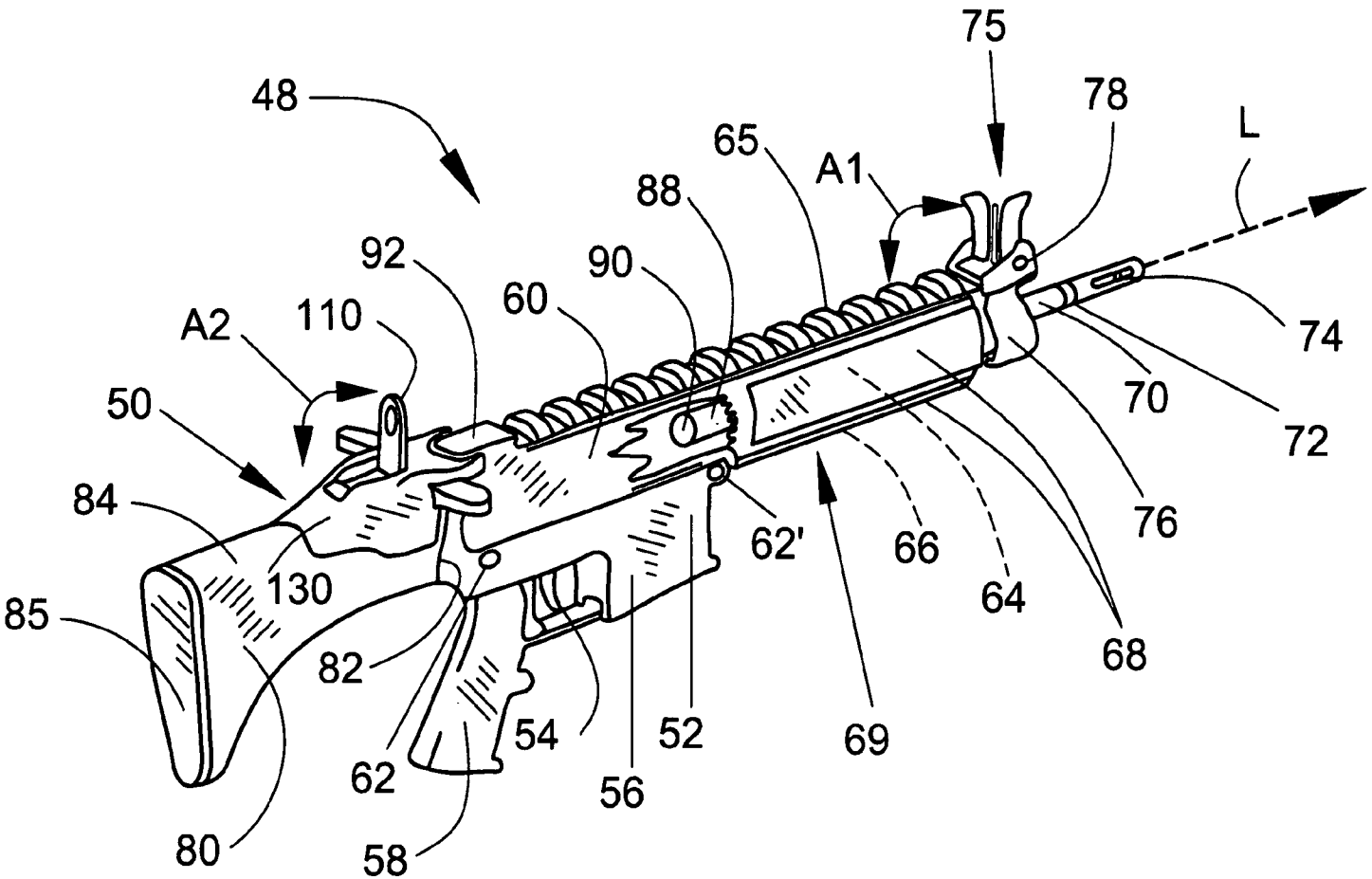
FIG. 1 is a perspective view of one form of a firearm, shown as one embodiment of a longarm, such as a rifle having a reciprocating sighting system shown in a firing position.

FIG. 1 illustrates one embodiment of a longarm firearm, here shown as an M16A4 rifle 48 having a reciprocating sighting system 50 constructed in accordance with one embodiment of the invention, which may be used by soldiers, law enforcement, and civilians for plinking, target shooting, hunting, competitive shooting, etc. The rifle 48 includes a frame comprising a lower receiver 52 which typically bears the rifle serial number. The lower receiver 52 houses a trigger mechanism culminating in a trigger 54 used to fire the rifle.

The receiver 52 also defines a magazine well 56, described in further detail below. A pistol grip 58 is attached to lower receiver 52, such as by a screw, bolt, or other mechanism. The illustrated frame also comprises an upper receiver 60 which may be secured to the lower receiver 52 by a pair of receiver disassembly or "takedown" pins 62, 62'. For clarity, several standard components of an M16A4 rifle have been omitted from the views, including an ejection port door, magazine release mechanism, forward assist, and a firing selector switch which may include a safety mechanism.

The upper receiver 60 may be precision machined as a unitary piece having one or more rails formed thereon, including a pair of opposing side rails, such as right rail 64, an upper rail 65, and a lower rail 66. The right and lower rails 64, 66 are each protected from damage by flexible rail covers 68 of a rubberized material, for example. The rails may be used to attach a variety of optional equipment to rifle 48, some of which are mentioned in the Background section above. The region of the rifle surrounded by rail covers 68 defines a forearm portion 69 of rifle 48.

A rifled barrel 70 extends from the firing chamber inside the upper receiver 60, through the forearm 69, and terminates in a muzzle 72. The muzzle 72 is shown coupled to a conventional muzzle break or flash suppressor 74. The barrel 70 defines a longitudinal bore axis L therethrough. A front sight 75 may be supported by the rifle forearm 69, or the upper rail 65 by a quick-release mounting member or mount 76. The front sight 75 may be pivotally attached to the mount 76 by a pivot pin 78. The front sight 75 pivots from an operational position shown in FIG. 1 (perpendicular to the barrel axis L) to a rest position (parallel to axis L), as indicated by a curved double-headed A1 arrow in FIG. 1. A variety of different sight styles are available for front sight 75.

The rifle 48 includes a stock 80 having a front end 82 which may be interchangeably attached to the lower receiver 52 in a conventional manner. The sighting system 50 may also be used with a variety of different styles of stocks, such as telescoping or collapsible stocks, and may be easily modified by those skilled in the art for use with folding stocks. The illustrated stock 80 has an upper surface 84, and terminates at a butt end 85 opposite the front end 82.

Before leaving FIG. 1, it should be noted that the barrel 70 has an entrance end 88 opposite muzzle 72 which extends from a firing chamber 90 defined in part by the rifle frame upper receiver 60. The bore axis L corresponds to a firing chamber exit path of a projectile being fired in response to activation of trigger 54. The firing chamber 90 may be constructed in a conventional manner known to those skilled in the art. The front end of upper receiver 60 has a rearwardly extending, overhanging shelf portion 92 which mates with the sighting system 50 as shown in FIG. 1, and is described in greater detail below with respect to FIG. 2.

Figure 2:
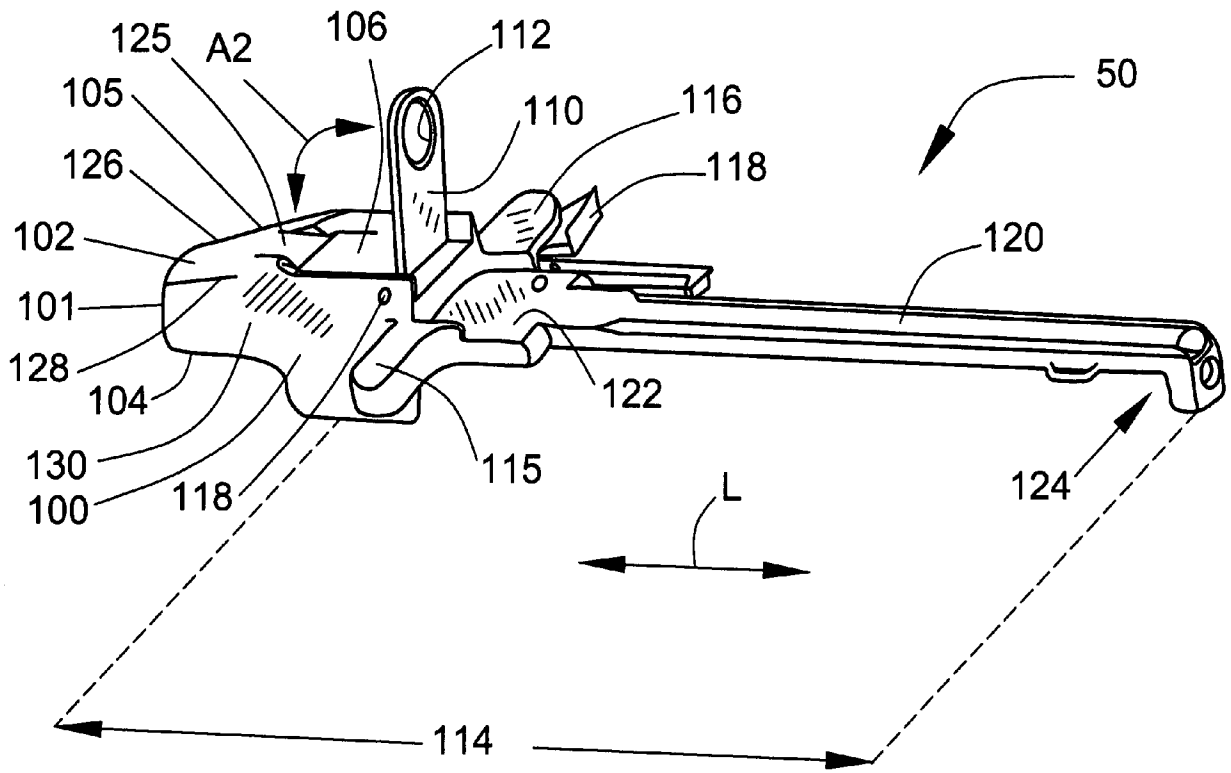
FIG. 2 is a perspective view of one embodiment of a cheek weld member of the system of FIG. 1.
Figure 3:
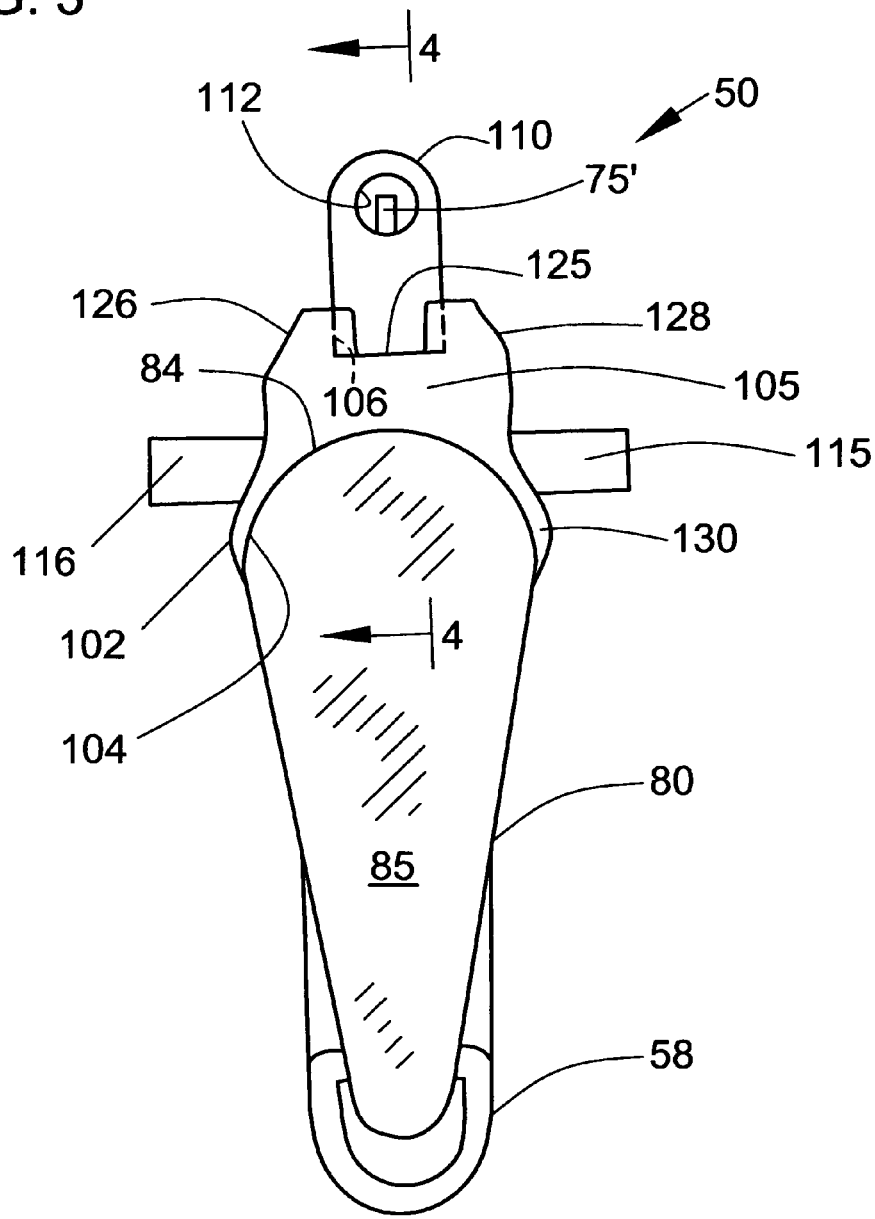
FIG. 3 is an enlarged left end view of the rifle of FIG. 1.
Figure 4:
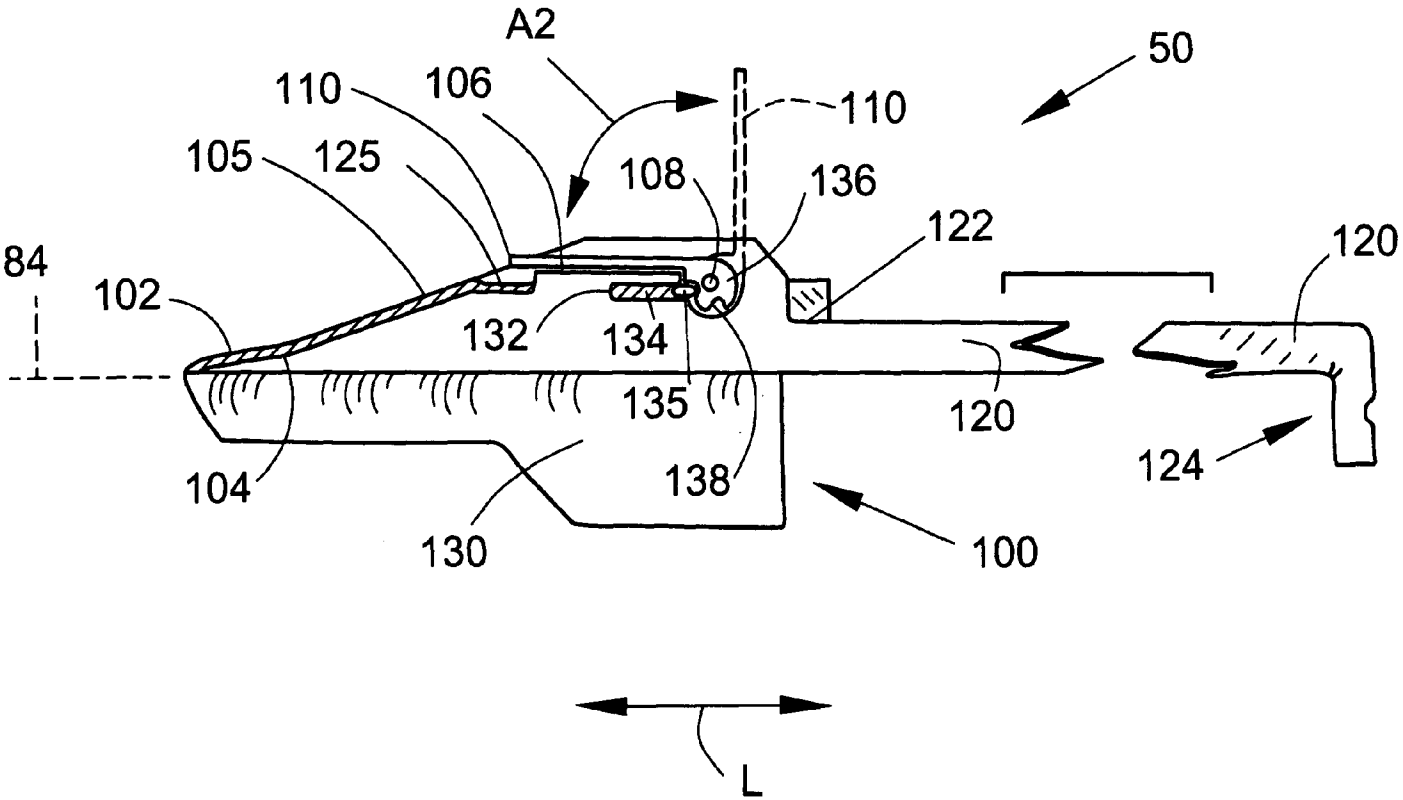
FIG. 4 is a fragmented, enlarged sectional view taken along lines 4-4 of FIG. 3, with a rear sight shown in a rest position, and omitting the longarm of FIG. 3 for clarity.

FIGS. 2-4 show one embodiment of a reciprocating sighting system 50 having a body 100 with a rear end 101, and defining an upper surface 102 and an undersurface 104. The upper surface 102 has an inclined contour defining a ramp portion 105 extending upwardly and forwardly from rear end 101, away from stock upper surface 84 (FIG. 4). The body 100 defines a recess forming a rear sight receiving pocket 106. A hinge or pivot pin 108 extends through body 100 and into pocket 106 to pivotally attach a rear sight member 110 to body 100. The rear sight 110 defines an aperture 112 therethrough for viewing a front sight post 75' to aim rifle 48 at a target (not shown).

The illustrated reciprocating sighting system 50 has components to the right of body 100 in FIG. 2 in region 114, which may be constructed in accordance with conventional charging handle assembly design principles. Indeed, in some embodiments it is preferable to have sighting system 50 be interchangeable with a conventional charging handle to promote retrofitting existing longarms with sighting system 50. This retrofit capability of system 50 allows customization of a shooter's longarm to better fit an individual's anatomy. For ease-of-use, the sighting system 50 uses a conventional operating mechanism comprising a pair of opposing charging handle grips 115 and 116, and a conventional spring-loaded charging handle release latch 118. The sighting system 50 includes a charging handle arm 120 which joins body 100 at a flat land portion 122. The land 122 fits underneath shelf 92 of upper receiver 60 when system 50 is in the firing position of FIG. 1. The arm 120 terminates in a conventional cartridge loading end piece 124 which moves a projectile-carrying ammunition round from a magazine or "clip" (item 142 in FIG. 6) in a manner well known to those skilled in the art.

Referring to FIG. 4, the body 100 defines a sight-opening depression or thumb relief 125 which allows an operator to quickly access the sight 110 for "opening" from the rest position of FIG. 4 (solid lines) to the open operating position (dashed lines). The body 100 defines a right-handed cheek weld 126 and an opposing left-handed cheek weld 128, referring to the dominant hand of the operator. As best shown in FIG. 3, body 100 has a saddle portion 130 which preferably rides over the upper surface 84 of stock 80.

FIG. 4 illustrates one manner of constructing the sighting system 50 to move the rear sight 110 between the rest position (solid lines) and the operational firing position (dashed lines). The body 100 defines a spring well 132 which houses a detent spring 134 that surrounds a detent pin 135. Opposite the sighting aperture 112, the sight 110 terminates in a cam member 136 having a pair of recessed detents, such as a firing detent 138, and a rest detent (unnumbered for clarity), shown engaged by detent pin 135 in FIG. 4. A variety of other sight adjusting mechanisms known to those skilled in the art may be employed instead of the illustrated detent members 132-138.

Figure 5:
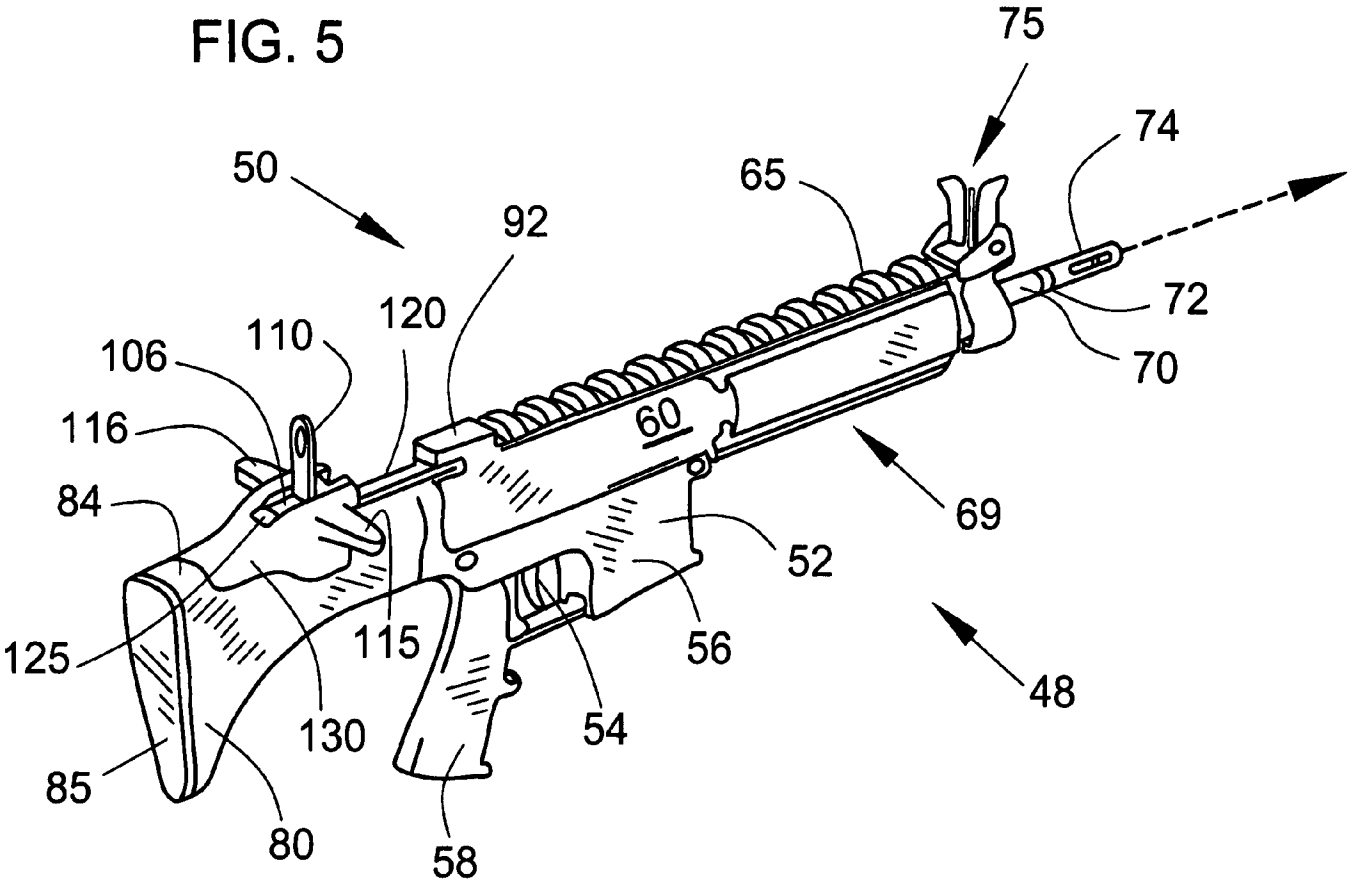
FIG. 5 is a perspective view of the reciprocating sighting system of FIG. 1, shown in a charging position.
Figure 6:
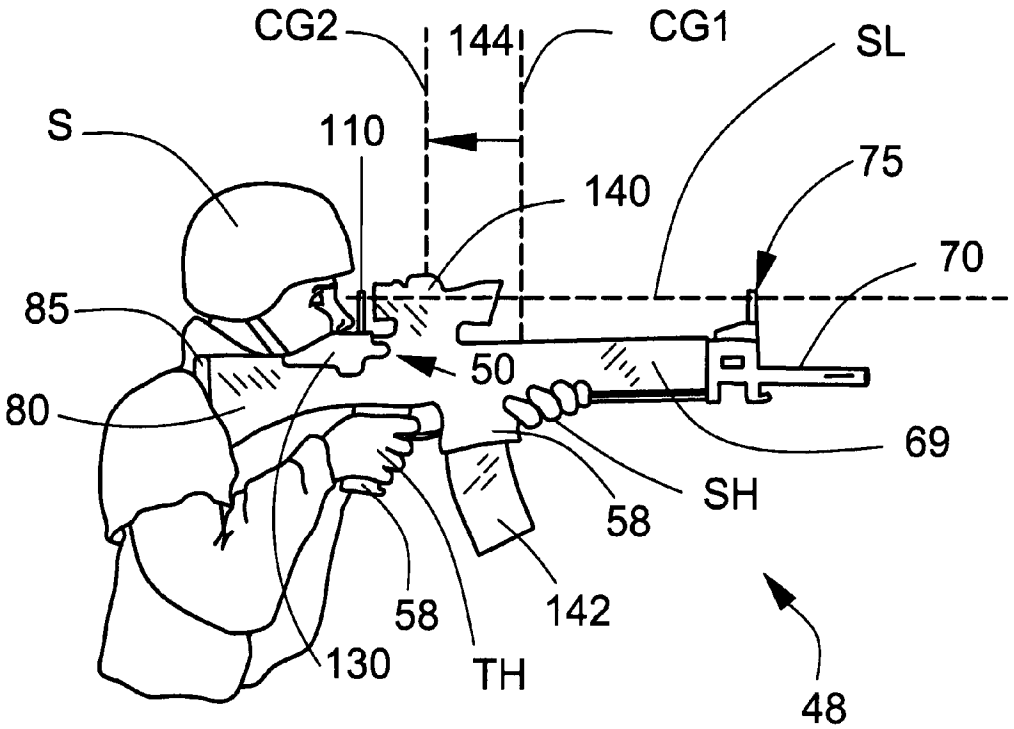
FIG. 6 is a perspective view of the rifle of FIG. 1 shown being used by a shooter.

FIGS. 5 and 6 show rifle 48 in operation. First, FIG. 5 shows the reciprocating sighting system 50 in a second, retracted, or charging position pulled back using grips 115 and 116, after squeezing release latch 118. The illustrated stock upper surface 84 has a uniform cross section with a substantially linear profile because the illustrated M16A4 rifle has several operational components located inside stock 80. These conventional internal components include a buffer tube and spring assembly (not shown) used to cycle a rifle bolt (not shown) forward, which loads a fresh round into firing chamber 90 during repeated firing. Second, FIG. 6 shows shooter S co-witnessing (aiming) rifle 48 using the backup reciprocating sighting system 50 following failure of an optical telescope or "scope" 140 mounted on rail 65. Rifle 48 is loaded with ammunition (not shown) held in a magazine or clip 142 received by the magazine well 58. This repetitive firing-and-reloading or cycling operation is in contrast to the initial loading operation accomplished using sighting system 50 after inserting a fresh ammo magazine 142 into well 58.

In the past, shooters often adapted the conventional rifle stock A by wrapping layers of duct tape or other spacing material along the upper surface of the stock to elevate the shooter's eye position for target acquisition. Rifle disassembly required removal of the sticky duct tape (leaving sticky tape residue on the stock to collect dirt and debris). Following reassembly of the rifle, the duct tape and spacers had to be reapplied to the stock and readjusted to fit the shooter. Using sighting system 50, the shooter S enjoys a proper cheek weld along edge 126 of ramp 105, which places the shooter's eye directly along the sight line SL. FIG. 6 illustrates using the front and rear backup sights 75, 110 upon failure of, or instead of, scope 140. Thus, sighting system 50 addresses the sight relief problem described in the Background section by positioning a shooter's eyeball at the design distance from scope 140 or rear sight 110 to achieve a clear sight picture.

Furthermore, moving the rear sight 110 rearwardly behind the receiver frame 52, 60 increases the sight distance (from front sight 75), which in the hands of a skilled shooter inherently increases the accuracy of firearm 48. Additionally, by moving sight 110 rearwardly away from scope 140 enhances the shooter's peripheral version, allowing the shooter to spot targets approaching from the side.

In the past, placing a firearm sight on a moving component was believed to bring inherent inaccuracy to the sighting system because movability equated to non-repeatability in the minds of those skilled in the art. Additionally, the need to keep the stock upper surface unobstructed for assembly and disassembly taught against using any type of a cheek weld saddle straddling the stock upper surface. Thus, with these constraints firmly embedded in the minds of firearm designers, shooters were left with field fixes like layering duct tape to attain an adequate sight picture.

Figure 8:
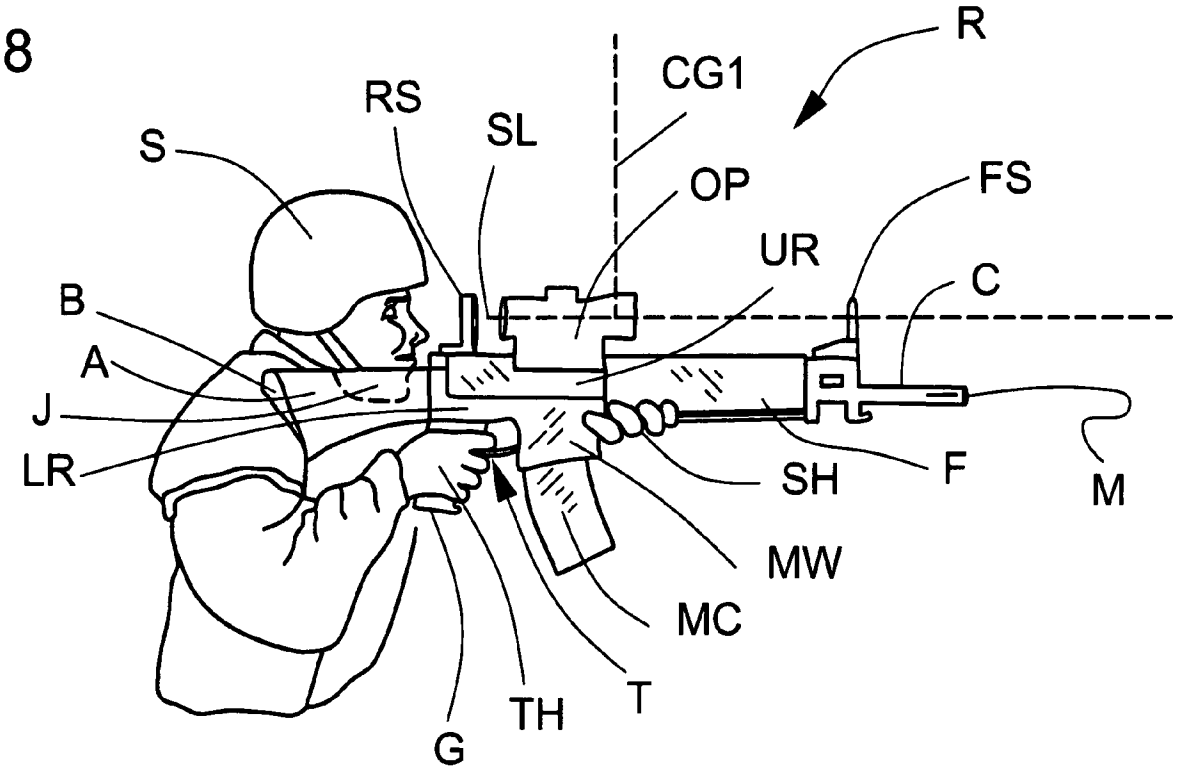
FIG. 8 Prior Art
FIG. 8 is a perspective view of a rifle having prior sighting system shown being used by a shooter forced into an improper "jaw weld" to obtain a sight picture.

Sighting system 50 addresses the cheek weld issue described in the Background section, as seen from a comparison of the proper cheek weld of FIG. 6 with the improper "jaw weld" of FIG. 8. The view of FIG. 6 clearly shows the consistent, repeatable positioning of rifle 48 made possible by relying on the bone structure of the shooter's skull, in contrast to relying on the shooter's moving jaw to elevate the eyeball to reach sight line SL (FIG. 8). Thus, the reciprocating sighting system 50 speeds target acquisition and facilitates accurate shooting.

Furthermore, the inclined ramp 105 of system 50 accommodates variations in each shooter's skull and tissue structure by allowing fine adjustments of sight picture by moving the cheek up or down the ramp. These fine adjustments may be required depending upon the shooting stance (e.g. prone versus offhand), tactical environment, lighting conditions, etc. For example, a first cheek position may be used for long-distance shooting, such as when guarding a position overlooking a trail. Then the situation may rapidly change to close quarter battle ("CUB") shooting if the guard post is infiltrated by the enemy, requiring rapid attainment of a CQB cheek position. As another combat example, when shooting in mountainous terrain, first an enemy target may be 500 meters across a ravine requiring the long-distance cheek position, and quickly switch to a second enemy target 50-meters away along the same side of the ravine as the shooter, requiring a short-distance cheek weld.

Comparing FIG. 6 with FIG. 8 also shows shifting of a prior art center of gravity CG1 rearwardly as illustrated by arrow 144 to a position along the improved center of gravity line CG2. This shift 144 is made possible by allowing the scope 142 be moved rearwardly from a position generally over the magazine well MG in FIG. 8, to a position generally behind magazine well 58 in FIG. 6. This rearward shift 144 of the center of gravity is made possible by moving the rear backup site RS from being mounted on the top rail (item 65 in FIGS. 1 and 5) and placing sight 110 on body 100 of the modified charging handle of sighting system 50. Furthermore, freeing up valuable rail "real estate" by moving the rear sight 110 to body 100 facilitates placement of additional accessories on rail 65 closer to the shooter, which moves the center of gravity CG2 further rearward. Shifting the center of gravity rearward (arrow 144) decreases muscle fatigue by lightening the weight held by the support hand SH.

Moreover, conventional backup rear sights RS are heavy, contributing to moving the prior art center of gravity CG1 forwardly, making the earlier rifles R front end heavy. These backup rear sights RS are also costly, on the order of $100, and can be knocked off the rail mount then lost during intense shooting, e.g., in combat or in competition. Thus, the reciprocating sight system 50 replaces the two-piece site RS and charging handle of FIG. 8 with a unitary single piece assembly combining the ramped cheek weld 105, rear sight 110, and charging handle 110.

Figure 7:
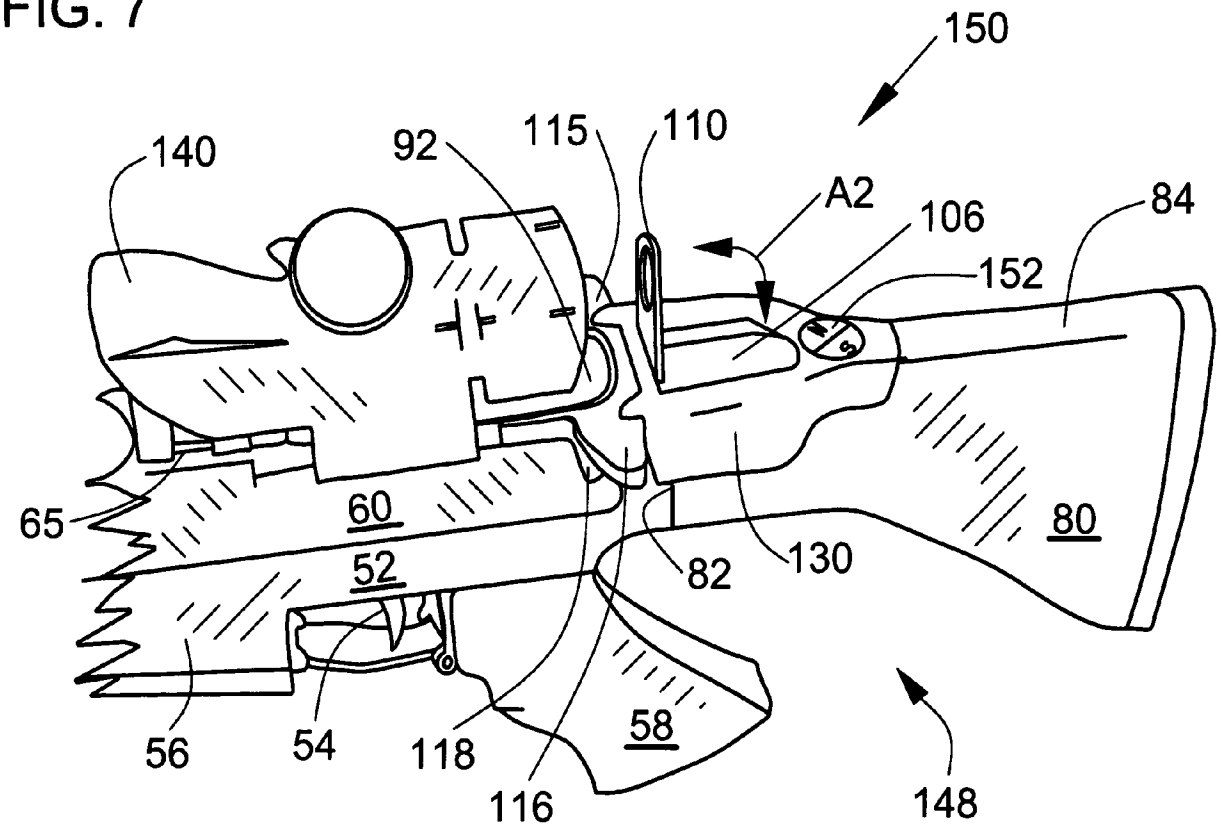
FIG. 7 is a perspective view of an alternate embodiment of a reciprocating system including one embodiment of a reciprocating sensory system for use with the rifle of FIG. 1, here shown for orienting a shooter, which may be employed with or without the sighting features of the FIG. 2 cheek weld member.

FIG. 7 illustrates one embodiment of a reciprocating sensory rifle 148 equipped with a reciprocating sensory system 150 having a body 152, which may be constructed in a similar fashion to body 100 of FIGS. 1-6. The sensory system 150 may optionally include sighting features of the reciprocating sight system 50, such as ramp 105, saddle 130, rear sight 110, the pair of grips 115, 116, and release latch 118 as illustrated in FIG. 7. The body 152 terminates in a rear end 154 which rides over the stock upper surface 84.

Located between the body rear end 154 and the rear portion of thumb relief 125, is a sensory assisting element, here illustrated as a compass 155. Placing a compass 155 on rifle 148 allows a shooter S to quickly obtain a general directional bearing (North, South, East or West), without wasting critical seconds removing a separate compass, or global positioning system (GPS) unit from a storage pocket. Accessing position/directional locating equipment from a storage pocket may generate noise, which gives away the shooter's position, and disrupts the shooting stance by removing the trigger hand TH from trigger 54, and or removing the support hand SH from forearm 69. Additionally in combat situations, fumbling around accessing stored equipment diverts a shooter's attention from the line of sight SL and potential targets (known as "unplugging from the fight"), leaving the shooter vulnerable to surprise attack. Thus, quickly obtaining a rough directional bearing using compass 155 may save the shooter's life.

Although the description above contains many specifics, these should not be construed as limiting the scope of the invention but as merely providing illustrations of some of the embodiments of this invention. Thus, the scope of the invention should be determined by the appended claims and their legal equivalents rather than by the examples, features and advantages given. Further, the present invention has been shown and described with reference to the foregoing exemplary embodiments. It is to be understood, however, that other forms, details, and embodiments may be made without departing from the spirit and scope of the invention which is defined in the following claims.

I claim:

1. A firearm, comprising:

a frame defining a firing chamber, the frame removably receives an ammunition supplier containing an ammunition round;

a barrel defining a bore having a first end coupled to the firing chamber and an opposing muzzle end;

a stock supported by the frame; and a cheek weld member movably coupled to the frame to float adjacent the stock between a firing position and a second position, and having a cheek seat for shooter engagement when in the firing position, wherein the cheek weld member loads the firing chamber with the ammunition round from the ammunition supplier when received by the frame while the cheek weld member travels between the second position and the firing position.

2. A firearm according to claim 1, further comprising:

a front sight supported by the barrel; and a rear sight supported by the cheek weld member for alignment by a shooter with the front sight and a target when the cheek seat is engaged by a cheek of the shooter with the cheek weld member in the firing position.

3. A firearm according to claim 2 wherein the rear sight is movable between a firing position and a rest position.

4. A firearm according to claim 1, wherein:

the barrel bore defines a longitudinal axis extending between the first end and muzzle end; and the cheek weld member floats substantially parallel to the longitudinal axis.

5. A firearm according to claim 1, wherein:

the stock has a first end supported by the frame and an opposing butt end; and the cheek seat has a rear end facing the stock butt end, and a ramped contour inclining upwardly from the rear end and away from the stock.

6. A firearm according to claim 1, wherein the cheek weld member comprises a saddle portion having an undersurface which straddles the stock during movement between the firing position and the second position, with the saddle portion having an outer surface which defines a left cheek seat for engagement during left-handed shooting, and a right cheek seat for engagement during right-handed shooting.

7. A firearm according to claim 1, wherein:

the cheek seat has a ramped contour inclining away from the stock in a direction toward the muzzle end;

the barrel bore defines a longitudinal axis;

the cheek weld member floats substantially parallel to the longitudinal axis, and comprises a saddle portion having an undersurface which straddles the stock during movement between the firing position and the second position, with the saddle portion having an outer surface defining the cheek seat with a left seat for engagement during left-handed shooting, and a right seat for engagement during right-handed shooting;

the firearm further comprises a front sight supported by the barrel; and the cheek weld member further comprises a rear sight supported for alignment by a shooter with the front sight and a target when the cheek seat is engaged by a cheek of the shooter while the cheek weld member is in the firing position.

8. A cheek weld member for a firearm having a frame defining a firing chamber and a passageway from an ammunition supplier to the firing chamber, with the firearm having a stock supported by the frame, comprising:

a body; and a frame engagement portion extending from the body and translationally couplable to the frame to reciprocate between a firing position and a second position, and upon returning to the firing position, moving an ammunition round from the ammunition supplier through the passageway to the firing chamber;

wherein the body has an exterior surface defining a cheek seat for shooter engagement when in the firing position; and wherein the body comprises a saddle portion having an undersurface which straddles the stock during movement between the firing position and the second position.

9. A cheek weld member according to claim 8 wherein the firearm stock extends from the frame to terminate in a butt end, wherein the cheek seat has a ramped contour inclining away from the stock in a direction from the butt end toward the frame.

10. A cheek weld member according to claim 8, further comprising a rear sight supported by the body for target alignment by a shooter when engaging the cheek seat in the firing position.

11. A firearm, comprising:

a frame defining a firing chamber and a passageway from an ammunition supplier to the firing chamber;

a stock supported by the frame;

a barrel having a first end coupled to the firing chamber, an opposing muzzle end, and defining a longitudinal axis between the first end and the muzzle end;

a front sight supported by the barrel adjacent the muzzle end; and a reciprocating sighting system translationally coupled to the frame to move between a firing position and a second position, and upon returning to the firing position, moving an ammunition round from the ammunition supplier through the passageway to the firing chamber, said reciprocating sighting system including a rear sight and a cheek weld member supporting the rear sight, with the cheek weld member comprising a saddle portion having an undersurface which straddles the stock during movement between the firing position and the second position, and with the saddle portion having an exterior surface defining a cheek seat for shooter engagement when in the firing position.

12. A firearm according to claim 11, wherein:

the barrel defines a longitudinal axis between the first end and the muzzle end; and the reciprocating sighting system moves translationally substantially parallel to the longitudinal axis.

13. A firearm according to claim 11, wherein the reciprocating sighting system has a body defining the saddle portion, with the body having an exterior surface defining a cheek seat for shooter engagement when in the firing position.

14. A firearm, comprising:

a frame defining a firing chamber, wherein the frame removably receives an ammunition supplier containing an ammunition round;

a barrel defining a bore having a first end coupled to the firing chamber and an opposing muzzle end;

a stock supported by the frame; and a cheek weld member movably coupled to the frame to float adjacent the stock between a firing position and a second position, and having a cheek seat for shooter engagement when in the firing position, wherein the cheek weld member has a frame engagement portion configured to serve as a charging handle used to load the firing chamber with the ammunition round from the ammunition supplier.

15. A firearm according to claim 14, further comprising:

a front sight supported by the barrel; and a rear sight supported by the cheek weld member for alignment by a shooter with the front sight and a target when the cheek seat is engaged by a cheek of the shooter with the cheek weld member in the firing position.

16. A firearm according to claim 15 wherein the rear sight is movable between a firing position and a rest position.

17. A firearm according to claim 14, wherein:

the barrel bore defines a longitudinal axis extending between the first end and muzzle end; and the cheek weld member floats substantially parallel to the longitudinal axis.

18. A firearm according to claim 14, wherein:

the stock has a first end supported by the frame and an opposing butt end; and the cheek seat has a rear end facing the stock butt end, and a ramped contour inclining upwardly from the rear end and away from the stock.

19. A firearm according to claim 14, wherein the cheek weld member comprises a saddle portion having an undersurface which straddles the stock during movement between the firing position and the second position, with the saddle portion having an outer surface which defines a left cheek seat for engagement during left-handed shooting, and a right cheek seat for engagement during right-handed shooting.

20. A firearm according to claim 14, wherein:

the cheek seat has a ramped contour inclining away from the stock in a direction toward the muzzle end;

the barrel bore defines a longitudinal axis;

the cheek weld member floats substantially parallel to the longitudinal axis, and comprises a saddle portion having an undersurface which straddles the stock during movement between the firing position and the second position, with the saddle portion having an outer surface defining the cheek seat with a left seat for engagement during left-handed shooting, and a right seat for engagement during right-handed shooting;

the cheek weld member loads the firing chamber with the ammunition round from the ammunition supplier when received by the frame while the cheek weld member travels between the second position and the firing position;

the firearm further comprises a front sight supported by the barrel; and the cheek weld member further comprises a rear sight supported for alignment by a shooter with the front sight and a target when the cheek seat is engaged by a cheek of the shooter while the cheek weld member is in the firing position.

* * * * *